US009708565B2

(12) United States Patent
Meijerhof

(10) Patent No.: US 9,708,565 B2
(45) Date of Patent: Jul. 18, 2017

(54) METHOD FOR REDUCING COLOR IN USED LUBRICATING OIL

(71) Applicant: Vertellus Performance Chemicals, LLC, Indianapolis, IN (US)

(72) Inventor: Antjo H. Meijerhof, Delfzijl (NL)

(73) Assignee: Vertellus Performance Chemicals, LLC, Indianapolis, IN (US)

( * ) Notice: Subject to any disclaimer, the term of this patent is extended or adjusted under 35 U.S.C. 154(b) by 0 days.

(21) Appl. No.: 14/372,459

(22) PCT Filed: Jan. 21, 2013

(86) PCT No.: PCT/US2013/022361

§ 371 (c)(1),
(2) Date: Jul. 16, 2014

(87) PCT Pub. No.: WO2013/112395

PCT Pub. Date: Aug. 1, 2013

(65) Prior Publication Data

US 2014/0357538 A1 Dec. 4, 2014

Related U.S. Application Data

(60) Provisional application No. 61/591,407, filed on Jan. 27, 2012.

(51) Int. Cl.
*C10M 175/00* (2006.01)
*C10M 125/26* (2006.01)

(52) U.S. Cl.
CPC .... *C10M 175/0016* (2013.01); *C10M 125/26* (2013.01); *C10M 2201/084* (2013.01); *C10M 2201/087* (2013.01)

(58) Field of Classification Search
CPC ..... C10M 175/0016; C10M 125/16; C10M 2201/084; C10M 2201/087
USPC ..... 508/155, 111; 208/179
See application file for complete search history.

(56) References Cited

U.S. PATENT DOCUMENTS

| | | | | |
|---|---|---|---|---|
| 3,167,515 | A * | 1/1965 | Hinckley | C01B 17/66 202/105 |
| 3,489,676 | A * | 1/1970 | Hu | C10M 175/0091 123/196 R |
| 4,269,698 | A | 5/1981 | Kreger | |
| 4,439,311 | A | 3/1984 | O'Blasny | |
| 4,504,383 | A | 3/1985 | O'Blasny | |
| 2006/0122076 | A1* | 6/2006 | Malz | C08K 5/13 508/478 |
| 2011/0232904 | A1* | 9/2011 | Lumsden | C09K 8/584 166/270.1 |
| 2013/0281338 | A1* | 10/2013 | Liu | C10M 133/36 508/503 |

FOREIGN PATENT DOCUMENTS

CN 102321145A A 1/2012

* cited by examiner

*Primary Examiner* — James Goloboy
(74) *Attorney, Agent, or Firm* — Barnes & Thornburg LLP

(57) ABSTRACT

A method for reducing color in used lubricating oil. The method comprises combining: (i) a used lubricating oil; (ii) an alkali metal borohydride; and (iii) a bisulfite or metabisulfite salt.

10 Claims, No Drawings

METHOD FOR REDUCING COLOR IN USED LUBRICATING OIL

BACKGROUND

The invention relates to improved methods for reducing color in used lubricating oil.

Reduction of color is an important step in treating used lubricating oils to render them suitable for recycling. Various methods have been described for accomplishing this. For example, PL 2004-364533 describes treatment of spent engine and gear oils with sodium borohydride.

Still, it remains desirable to develop improved, alternate processes for reducing color in used lubricating oil.

STATEMENT OF THE INVENTION

This invention is directed to a method for reducing color in used lubricating oil. The method comprises combining: (i) a used lubricating oil; (ii) an alkali metal borohydride; and (iii) a bisulfite or metabisulfite salt.

DETAILED DESCRIPTION OF THE INVENTION

All percentages are expressed as weight percentages (wt %) and all temperatures are in ° C., unless specified otherwise. "Used oil" is lubricating oil that has been in contact with an engine, or other device having moving parts lubricated by oil. Typically used oil is considered no longer suitable for use due to partial decomposition of the oil and/or its additives.

Dithionite ion can be produced by the reaction between bisulfite and borohydride ions, according to the following theoretical equation, $$BH_4^- + 8HSO_3^- + H^+ \rightarrow 4S_2O_4^{-2} + B(OH)_3 + 5H_2O$$

although a complex mixture results from interaction of borohydride and bisulfite, especially if the stoichiometry is not the theoretical 8:1, bisulfite:borohydride molar ratio indicated by the equation. Since the exact mechanism of the reaction has not been fully characterized, and "off-stoichiometry" mixtures are highly complex, this invention is not limited to reduction by dithionite ion, and other species present in the reaction mixture also may act as reducing agents or may act to decolorize by other mechanisms.

Preferably, the alkali metal borohydride is sodium, potassium or lithium borohydride; preferably sodium or potassium; preferably sodium. Borohydride may be added as solid alkali metal borohydride or as a solution of alkali metal borohydride in water. Preferably, borohydride is added in the form of an aqueous solution containing sodium borohydride and sodium hydroxide. A preferred solution containing borohydride comprises about 1% to about 40% active alkali metal borohydride and about 10 to about 45% alkali metal hydroxide, all by weight. Preferably, the borohydride solution contains from 10% to 25% alkali metal borohydride and 15% to 42% alkali metal hydroxide, preferably from 15% to 25% alkali metal borohydride and 17% to 25% alkali metal hydroxide. Preferably, the alkali metal hydroxide is sodium or potassium hydroxide, preferably sodium hydroxide.

As described above, the theoretical reaction of borohydride and bisulfite requires 8 moles of bisulfite per mole of borohydride, i.e., the molar ratio of bisulfite to borohydride is at least 8:1. Preferably, the present invention uses a ratio no more than 8:1. Preferably, the ratio is no more than 7.5:1, preferably no more than 7:1, preferably no more than 6.8:1, preferably no more than 6:1; preferably, the ratio is at least 1:1, preferably at least 2:1, preferably at least 3:1, preferably at least 4:1. Use of any ratio lower than the theoretical value of 8:1 produces cost savings from decreased usage of bisulfite, relative to the conventional stoichiometric process.

Preferably at least 0.05% of bisulfite, based on the weight of used oil, is added to the used oil, preferably at least 0.1%, preferably at least 0.15%, preferably at least 0.2%;

preferably no more than 0.6%, preferably no more than 0.5%, preferably no more than 0.45%, preferably no more than 0.4%, preferably no more than 0.35%. Preferably, bisulfite is generated by combining water and sodium metabisulfite, $Na_2S_2O_5$.

Preferably, the borohydride solution and the bisulfite solution are mixed just prior to adding them to the used oil. The solutions may also be added separately to the used oil. Preferably, the borohydride and bisulfite solutions are mixed at a temperature in the range from 4° C. to 50° C., more preferably from 10° C. to 35° C. Preferably, the mixed borohydride and bisulfite solutions are stored in a vessel for later addition to the used oil, preferably within 12 hours of mixing, more preferably within 6 hours, more preferably within 3 hours, more preferably within 1 hour, and most preferably within ½ hour of mixing. Preferably, the mixed solutions are added directly to the used oil in less than 15 minutes, more preferably less than 10 minutes, and most preferably less than 5 minutes. Preferably, the amount of borohydride added to the used oil, measured as the percentage of alkali metal borohydride relative to the weight of the used oil, is at least 0.01%, preferably at least 0.02%, preferably at least 0.03%, preferably at least 0.04%. Preferably, the amount of borohydride added to the used oil, measured as the percentage of alkali metal borohydride to the weight of the used oil, is no more than 0.1%, preferably no more than 0.09%, preferably no more than 0.08%, preferably no more than 0.07%. Preferably, a 20% aqueous sodium borohydride solution is used, and the weight of the solution used, measured as a percentage of the used oil, is at least 0.05%, preferably at least 0.1%, preferably at least 0.15%. Preferably, the weight of solution used, measured as a percentage of the used oil, is no more than 0.5%, more preferably no more than 0.45%, and most preferably no more than 0.4%.

The method of this invention may be used in conjunction with other purification treatments for used oil, e.g., filtration, pH adjustment, physical absorption (activated carbon, clay, silica), flash distillation. Preferably, after treatment of the oil with borohydride and bisulfite, from 5% to 30% of the total mass is removed by distillation to remove water and other relatively volatile compounds, preferably from 15% to 25%.

EXAMPLES

Spent oil from a marine engine with 200 running hours was used for this trial. There was no water in the oil.

Chemicals

SBH Process:

An aqueous solution containing 20% of sodium borohydride and 20% NaOH was diluted ten-fold with water (10% of the solution and 90% added water) just before the resulting SBH solution was added to the oil samples.

SBS-SBH Process:

20% $NaHSO_3$ (SBS) in water and the SBH solution described for the SBH process above were freshly prepared. Corresponding amounts of SBH solution, water and SBS solution were mixed, just before the resulting solution was added to the oil samples.

Water—The total water content was kept at 9%

Decolorization Procedure Laboratory Trial 1

Sample 1

First Step 0.02% SBH with water (0.1% of the SBH solution described above, based on weight of oil) was added to the preheated oil (80° C.)

20% of the total weight was removed by vacuum distillation. (100 mbar)

Boiling range was between 90° C. and 180° C.

The temperature was measured before the cooler with an infrared camera.

Second Step

60% of the lubricating oil fraction was also removed by vacuum distillation. The boiling range was between 180° C. and 260° C. This fraction is the treated oil sample.

20% was left in the bottom as residue.

Sample 2

First Step 0.02% SBH with water (0.1% of the SBH solution described above, based on weight of oil) and SBS with a molar SBS/SBH ratio of 4 with water was added to the preheated oil. (80° C.). 20% of the total weight was removed by vacuum distillation, with the remainder comprising the treated oil sample. The boiling range was between 90° C. and 180° C. (100 mbar, $10^4$ Pa) The temperature was measured before the cooler with an infrared camera.

Second Step

Is the same as from sample 1

Results Laboratory Trial 1

Bottle 1 is the spent lubrication oil used for trial 1

Bottle 2 is the result from sample 1 with 0.02% SBH

Bottle 2 is the result from sample 2 with 0.02% SBH and SBS with a SBS/SBH molar ratio=4

Decolorization Procedure Laboratory Trial 2

For the second trial used lubrication oil was first distillated without chemicals and water. 60% of the lubricating oil fraction was removed by vacuum distillation.

Boiling range was between 180° C. and 260° C. This oil was used for the next trials.

Sample 1: 0.02% SBH

Sample 2: 0.02% SBH with SBS, molar ratio 4

Sample 3: 0.04% SBH

Sample 4: 0.04% SBH with SBS, molar ratio 4

Sample 5: 0.06% SBH

Sample 6: 0.06% SBH with SBS, molar ratio 4

Samples 1 till 6

Chemicals with water was added to the preheated oil (80° C.)

9% of the total weight was removed by vacuum distillation. (100 mbar, $10^4$ Pa)

Boiling range was between 90° C. and 110° C. and the retention time was 30 minutes.

The bottom product is the final refined lubrication oil. (See picture)

Results Laboratory Trial 2

Bottle 1 is the spent lubrication oil used for trial 2

Bottle 2 is the lubrication oil after distillation without chemicals and water, this oil is used for Samples 1 till 6

Bottle 3 is the result from sample 1 with 0.02% SBH

Bottle 4 is the result from sample 2 with 0.02% SBH with SBS molar ratio 4

Bottle 5 is the result from sample 3 with 0.04% SBH

Bottle 6 is the result from sample 4 with 0.04% SBH with SBS molar ratio 4

Bottle 7 is the result from sample 5 with 0.06% SBH

Bottle 8 is the result from sample 6 with 0.06% SBH with SBS molar ratio 4

Color measurement was done according to ASTM D1500 method for color of petroleum products (ASTM Color Scale)

The equipment was from HACH LANGE model LICO 150.

The results for bottles 2-8:

| | SBH | SBS/SBH mole ratio | Color Measurement ASTM 1500 D | improvement % | difference (SBH) – (SBH/SBS) % |
|---|---|---|---|---|---|
| 2 | | | 5.5 | | |
| 3 | 0.02% | | 4.2 | 23.64 | |
| 4 | 0.02% | 4 | 4 | 27.2 | 3.56 |
| 5 | 0.04% | | 4.2 | 23.64 | |
| 6 | 0.04% | 4 | 3.7 | 32.72 | 9.08 |
| 7 | 0.06% | | 4.2 | 23.64 | |
| 8 | 0.06% | 4 | 3.9 | 29.09 | 5.45 |

Note:
oil in bottle 6 was cloudy

The invention claimed is:

1. A method for reducing color in used lubricating oil comprising (a) combining an aqueous alkali metal borohydride mixture comprising from about 1% to about 40% alkali metal borohydride and from about 10% to about 45% alkali metal hydroxide with a bisulfite or metabisulfite salt to provide an aqueous alkali metal dithionite reagent, and (b) contacting the aqueous alkali metal dithionite reagent with a used lubricating oil to provide a used lubricating oil purification composition.

2. The method of claim 1, wherein a molar ratio of bisulfite or metabisulfite to alkali metal borohydride is from 4:1 to 8:1.

3. The method of claim 2, wherein the alkali metal borohydride in step (a) is used in an amount from 0.01 wt % to 0.1 wt %, based on weight of the used lubricating oil.

4. The method of claim 3, wherein the aqueous alkali metal borohydride mixture is an aqueous sodium borohydride mixture.

5. The method of claim 4, wherein the sodium borohydride in step (a) is used in an amount from 0.02 wt % to 0.08 wt %, based on weight of the used lubricating oil.

6. The method of claim 1, further comprising (c) distilling the used lubricating oil purification composition to remove water and other volatile compounds.

7. The method of claim 6, wherein from 5% to 30% of the total mass of the used lubricating oil purification composition is removed by distilling.

8. The method of claim 1, wherein the aqueous alkali metal borohydride mixture comprises from about 10% to about 25% alkali metal borohydride and from about 17% to about 25% alkali metal hydroxide.

9. The method of claim 3, wherein the aqueous alkali metal borohydride mixture comprises from about 10% to about 25% alkali metal borohydride and from about 17% to about 25% alkali metal hydroxide.

10. The method of claim 4, wherein the aqueous alkali metal borohydride mixture comprises from about 10% to about 25% alkali metal borohydride and from about 17% to about 25% alkali metal hydroxide.

* * * * *